United States Patent [19]

Mizuno et al.

[11] Patent Number: 4,755,332

[45] Date of Patent: Jul. 5, 1988

[54] METHOD OF AND APPARATUS FOR PELLETIZING RADIOACTIVE WASTE POWDER

[75] Inventors: Hiroko Mizuno; Makoto Kikuchi; Shin Tamata; Satoru Ohashi; Tadashi Sakuraoka, all of Hitachi, Japan

[73] Assignee: Hitachi, Ltd., Tokyo, Japan

[21] Appl. No.: 850,667

[22] Filed: Apr. 11, 1986

[30] Foreign Application Priority Data

Apr. 12, 1985 [JP] Japan ..... 60-76485

[51] Int. Cl.[4] ..... G21C 21/00; G21F 9/36

[52] U.S. Cl. ..... 264/0.5; 100/903; 100/906; 252/626; 425/352; 425/355; 425/356; 425/406; 425/411; 425/420; 425/422; 425/812

[58] Field of Search ..... 252/626, 628, 632; 425/233, 406, 408, 812, 422, DIG. 244, 355, 215, 356, 203, 411, 352, 416, 351, 420, ; 419/38; 264/0.5, 71, 294, 299; 100/110, 215, 906, 903, 909

[56] References Cited

U.S. PATENT DOCUMENTS

| | | | |
|---|---|---|---|
| 3,524,220 | 8/1970 | Davison | 425/356 |
| 3,606,637 | 9/1971 | Lawless | 425/420 |
| 3,804,566 | 4/1974 | Kimura et al. | 425/420 |
| 3,804,570 | 4/1974 | Hoschele et al. | 425/420 |
| 4,147,489 | 4/1979 | Milburn et al. | 425/355 |
| 4,147,490 | 4/1979 | Stewart | 425/355 |
| 4,384,834 | 5/1983 | Wichoud | 425/355 |
| 4,452,733 | 6/1984 | Horiuchi et al. | 252/632 |
| 4,538,666 | 9/1985 | Takeshima et al. | 425/420 |
| 4,545,755 | 10/1985 | Furch et al. | 425/420 |

FOREIGN PATENT DOCUMENTS

| | | | |
|---|---|---|---|
| 58-100799 | 6/1983 | Japan . | |
| 58-100800 | 6/1983 | Japan . | |
| 58-108497 | 6/1983 | Japan . | |
| 0546480 | 3/1977 | U.S.S.R. | 425/420 |
| 0903164 | 2/1982 | U.S.S.R. | 425/420 |

*Primary Examiner*—Stephen J. Lechert, Jr.
*Assistant Examiner*—Howard J. Locker
*Attorney, Agent, or Firm*—Fay, Sharpe, Beall, Fagan, Minnich & McKee

[57] ABSTRACT

A method of and apparatus for pelletizing a radioactive waste powder is disclosed. The apparatus includes a pelletizing section, and a pelletizing die which has one end facing a powder receiving cavity formed in the pelletizing section and the other end exposed to the atmosphere, and a through bore is so formed in the die as to pass from the one end to the other end. A first pelletizing rod can be inserted into and pulled out of the through bore from the one end of the die through the cavity, and a second pelletizing rod can be inserted into a pulled out of the through bore from the other end of the die. The first and second rods are arranged such that, when the second rod takes a predetermined position in the through bore, the first rod is inserted through the receiving cavity into the through bore, thereby enabling the pelletizing operation of the powder within the through bore. The structure is adopted for allowing air compressed in the through bore to be discharged into the cavity without causing the compressed air to leak into the atmosphere during the pelletizing operation.

13 Claims, 5 Drawing Sheets

METHOD OF AND APPARATUS FOR PELLETIZING RADIOACTIVE WASTE POWDER

BACKGROUND OF THE INVENTION

1. Field of the Invention

The present invention relates to a method of and an apparatus for pelletizing a radioactive waste, and more particularly, to a method of and an apparatus for pelletizing a radioactive waste in which it is possible to shorten the compressing time required when a waste powder is to be compressed or press-molded into a pellet, and to prevent environmental pollution from being caused by the waste powder which may be scattered during the pelletizing operation.

2. Description of the Prior Arts

A radioactive waste has been increasingly produced by an atomic power plant concurrently with an increase in the quantity of produced electricity, and therefore, the need for volume-reducing treatment of a radioactive waste has been increased in order to ensure a storage space in a facility. One method of reducing the volume of a radioactive waste has heretofore been proposed in which a concentrated waste liquid (the main component is a soda sulfate) obtained from the concentration of a waste liquid regenerated from ion exchange resins which are produced in large quantities by a boiling water reactor and granular ion exchange resin slurry are dried and milled so as to remove water occupying a large percent of the volume of a radioactive waste, and the thus-treated powder is formed and solidified into a pellet by using a tablet type pelletizer, or alternatively, after inflammable solid wastes have been burnt, the thus-produced ashes are formed and solidified into a pellet by using the tablet type pelletizer.

Such method of pelletizing a radioactive waste by the use of the tablet type pelletizer is disclosed in the specifications of Japanese patent unexamined publication No. 100799/1983, Japanese patent unexamined publication No. 100800/1983, and Japanese patent unexamined publication No. 108497/1983. However, these publications only disclose a mixing ratio or a compressive force connected with a radioactive waste powder.

According to one of conventional pelletizing methods using the above-mentioned pelletizer, a radioactive waste powder is supplied into a powder receiving cavity formed in a pelletizing section of the pelletizer, and the powder is pelletized within a through bore of a pelletizing die which extends from one end facing the powder receiving cavity to the other end facing the atmosphere, by inserting a first pelletizing rod from the side of the one end of the through bore, through the cavity, into the through bore under condition that a second pelletizing rod is inserted into the through bore by a predetermined length through the other end into the through bore. The waste powder is thus pelletized in a compressed manner within the through bore. However, such prior-art method involves disadvantage in that compressed air is not easily discharged through the through bore and compressing time correspondingly becomes longer. This is because the gap between the first pelletizing rod and the through bore and that between the second pelletizing rod and the through bore constitute minute gaps having substantially the same size or width and the air compressed during the pelletizing or press-molding operation is expelled through the minute gaps out of the through bore. In addition, the above-mentioned method involves a problem in that the compressed air passes through the respective gaps between the through bore and both rods and flows into not only the powder receiving cavity but also the atmosphere, so that part of the waste powder is mixed with the air flowing into the atmosphere, thus raising the problem of environmental pollution.

SUMMARY OF THE INVENTION

An object of the present invention is to provide method of and an apparatus for pelletizing a radioactive waste powder which is capable of eliminating the above-described disadvantages of the prior art by shortening the compressing time expended during a pelletizing operation and preventing the waste powder from being scattered together with air discharged into the atmosphere.

Accordingly, in accordance with one aspect of the present invention, there is provided a method of pelletizing a radioactive waste powder comprising the steps of: supplying the radioactive waste powder in a powder receiving cavity defined in a pelletizing section of a pelletizer;

pelletizing the powder within a through bore formed in a pelletizing die by inserting a first pelletizing rod through the receiving cavity into the through bore through one end thereof facing the receiving cavity under condition that a second pelletizing rod is inserted into the through bore by a predetermined length through the other end of said through bore facing the atmosphere, the through bore extending in the pelletizing die from the one end to the other end; and allowing an air compressed in the through bore in the pelletizing step to be discharged into the receiving cavity through the one end without causing the air to leak into the atmosphere through the other end of the through bore.

In accordance with another aspect of the present invention, there is provided an apparatus for pelletizing a radioactive waste powder comprising: a pelletizing section; a pelletizing die which has one end facing a cavity defined in the pelletizing section for receiving the radioactive waste powder and the other end exposed to the atmosphere, the pelletizing die being formed therein with a through bore extending from the one end to the other end of the die; a first pelletizing rod arranged to be inserted through the receiving cavity into the through bore from the one end of the die such as to be capable of being drawn out therefrom; a second pelletizing rod arranged to be inserted into the through bore from the other end of the die such as to be capable of being drawn out therefrom; the first and second pelletizing rods being arranged in such a manner that, when the second pelletizing rod is kept stationary in a position inserted in the through bore by a predetermined amount, the first pelletizing rod is inserted though the receiving cavity into the through bore, thereby enabling the pelletizing operation of the powder within the through bore; and an air discharge for allowing air compressed in the through bore to be discharged into the receiving cavity without causing the compressed air to leak into the atmosphere during the pelletizing operation.

The above and other objects, features and advantages of the present invention will become apparent from the following description of the preferred embodiments thereof, taken in conjunction with the accompanying drawings.

BRIEF DESCRIPTION OF THE DRAWINGS

Throughout the accompanying drawings, the same constituent elements are indicated by like reference numerals.

DETAILED DESCRIPTION OF THE PREFERRED EMBODIMENTS

Figure 1:
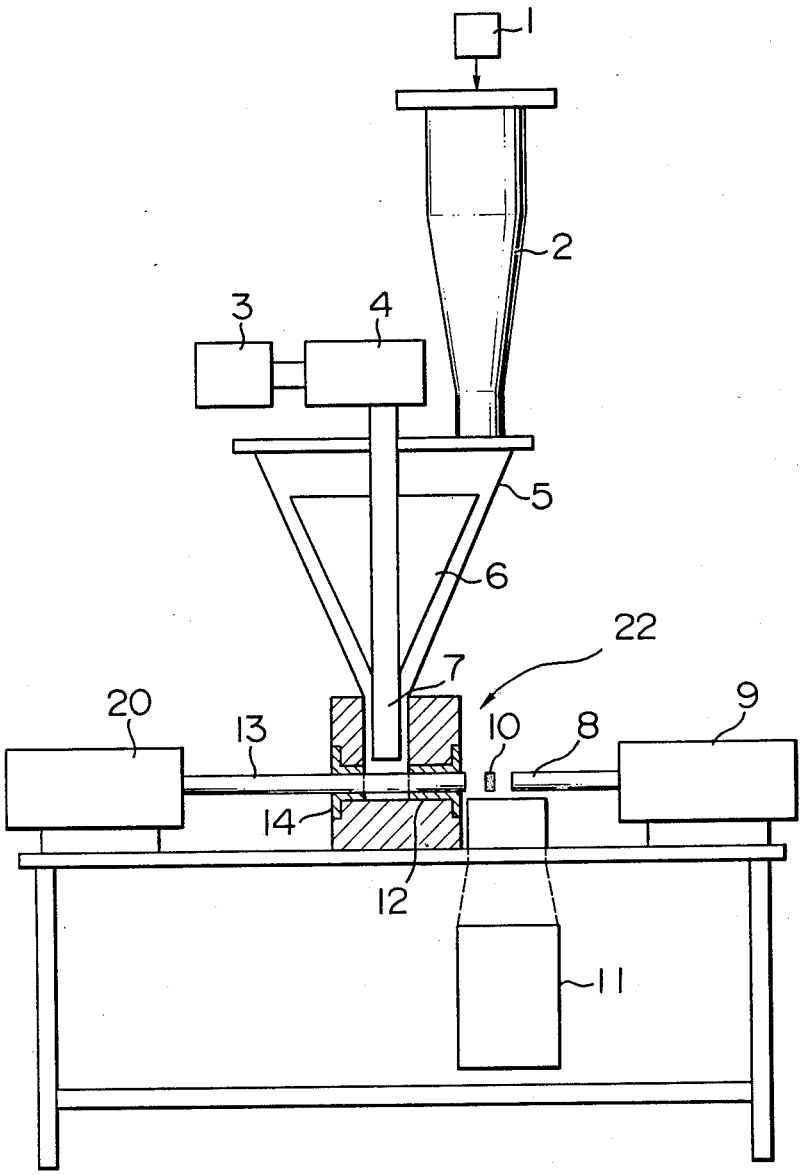
FIG. 1 is a schematic front elevational view showing one example of the structure of a tablet type pelletizer to which the present invention may be applied.

FIG. 1 shows one example of the structure of a tablet type pelletizer to which the present invention may be applied. In FIG. 1, a radioactive waste powder 1 is charged into a powder hopper 5 through a powder chute 2 in a pushed manner, and, as the powder is compactly pushed, a large quantity of air contained in the powder is forced upwardly in the hopper 5 and is removed from the powder. On the other hand, the thus-pushed powder is mixed by a mixing blade 6 and a mix-supplying blade 7 which are driven by a motor 3 via a governor 4, thereby enhancing the density of powder particles. The radioactive waste powder 1 whose particle density is thus made high due to the mixture performed in the hopper 5 is introduced into the powder receiving cavity defined in a pelletizing section 22.

As clearly shown in FIGS. 2 through 5, the pelletizing section 22 has a pair of dies 12, 14 which are separately located on the right and left sides, and the above-mentioned powder receiving cavity 23 is defined between the pair of dies 14, 12. The die 12 on the right side constitutes a pelletizing die, and it has an inner end 12*a* facing the receiving cavity 23 and an outer end 12*b* exposed to the atmosphere, a through bore 12*c* being so formed as to pass from the inner end 12*a* to the outer end 12*b*. A hydraulic cylinder 9 is disposed on the right side of the die 12, and a second pelletizing rod or outlet rod 8 is disposed so as to be driven by the hydraulic cylinder 9 in a reciprocal manner, thereby allowing the rod 8 to be inserted into or pulled out of the through bore 12*c* on the side of the outer end 12*b*. Another hydraulic cylinder 20 is disposed on the left side of the die 14, and a first pelletizing rod or inlet rod 13 is adapted to be inserted into or pulled out of the through bore 12*c* on the side of the inner end 12*a*. When the rod 13 passes through the die 14, the reciprocal movement of the inlet rod 13 is guided by the die 14 itself.

The powder which is charged into the powder receiving cavity 23 is pelletized by the operation of the outlet rod 8 and the inlet rod 13 within the through bore 12*c* under certain pelletizing conditions (a compressive force, a compressing time and so forth), thereby obtaining a pellet 10 having the diameter and thickness which remains within a preferred range.

Figure 2:
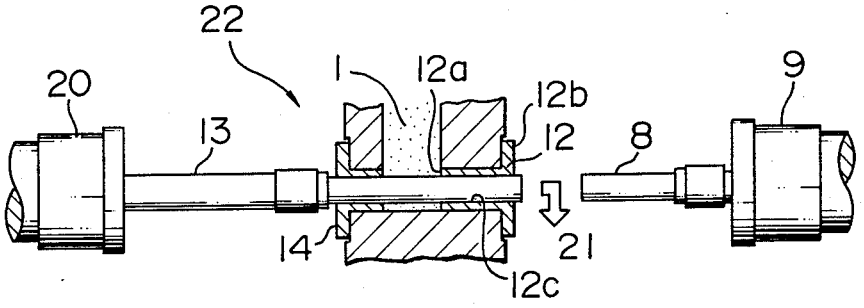
FIGS. 2 through 5 are fragmentary, sectional views used for explaining a method of press-molding the powder into pellets in the pelletizing section of the pelletizer shown in FIG. 1.
Figure 3:
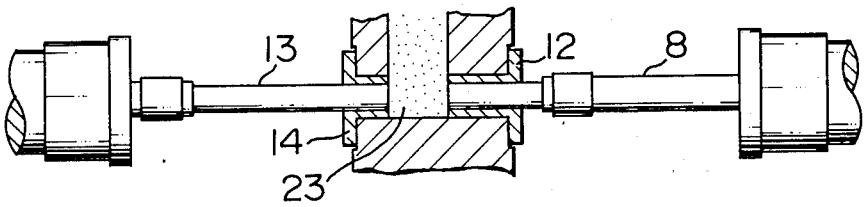
Figure 4:
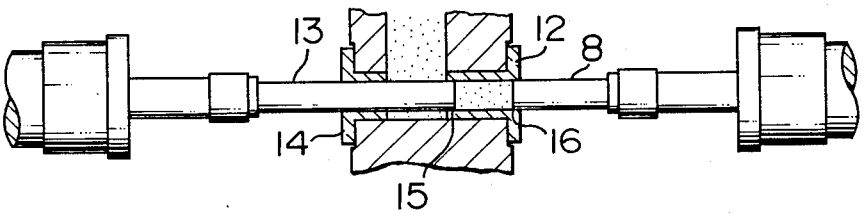
Figure 5:
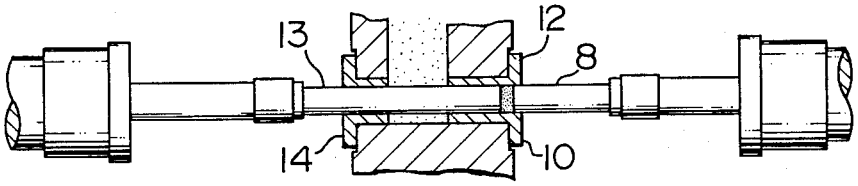

FIGS. 2 through 5 show how the powder 1 introduced into the receiving cavity 23 is compressed or press-molded into the pellet 10. More specifically, FIG. 2 shows a state in which a formed or molded pellet has been released in the direction of an arrow 21. In this state, the hydraulic cylinders 9, 20 are actuated to cause the leftward movement of the inlet rod 13 and the outlet rod 8. In the state shown in FIG. 3, another powder is charged into the receiving cavity 23 for the next pelletizing operation. Subsequently, as shown in FIG. 4, the inlet rod 13 and the outlet rod 8 travels rightwardly so as to transfer the powder 1 from the inner end or inlet end 12*a* of the die 12 into the through bore 12*c*. The rightward movement of the outlet rod 8 is stopped at a location in which an inner end thereof is inserted by partially into the die 12 through the outer end 12*b* and the rod 8 is kept stationary at this location as shown in FIG. 4. When the inlet rod 13 further travels rightwardly as shown in FIG. 5, the powder 1 within the through bore 12*c* is gradually compressed and the pellet 10 is formed. Subsequently, the cycle shown in FIGS. 2 to 5 is repeated, thereby enabling the continuous formation of the pellet 10.

Figure 6:
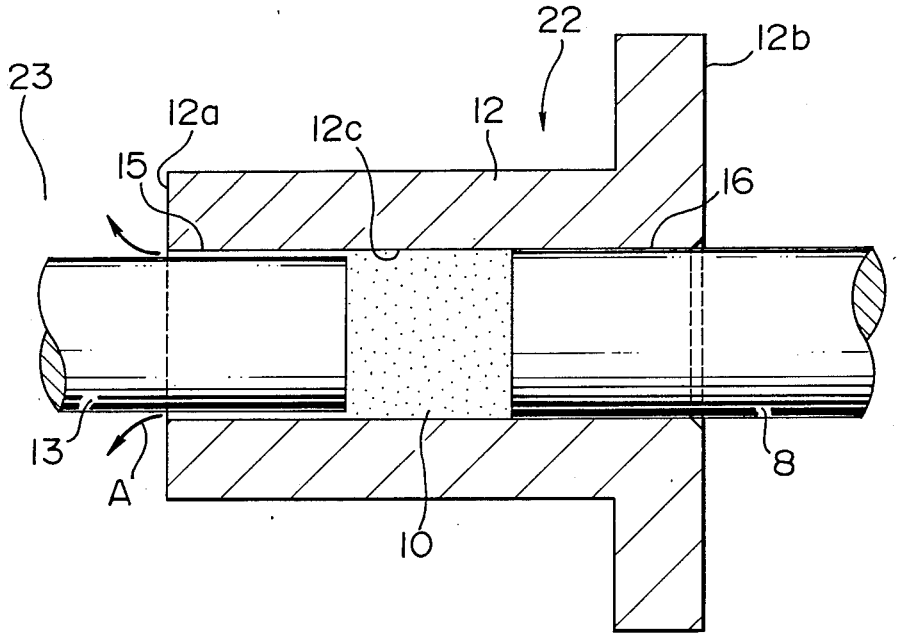
FIG. 6 is a sectional view showing the essential portion of a first embodiment of the pelletizing apparatus according to the invention.

FIG. 6 shows the essential portion of the first embodiment of the pelletizing apparatus of the present invention. This first embodiment is an improvement in the pelletizing section 22 of the above-described tablet type pelletizer, and a part of the improved pelletizing section 22 is shown on an enlarged scale in FIG. 6. More specifically, the pelletizing portion 22 includes the pelletizing die 12 having one end or the inlet end 12*a* facing the receiving cavity 23 for a radioactive waste powder and the other end or the outlet end 12*b* exposed to the atmosphere. The through bore 12*c* is formed in the die 12 in such a manner as to pass from the one end 12*a* to the other end 12*b*, and through bore 12*c* has a substantially identical diameter along substantially the entire length thereof. As described above, the first pelletizing rod, i.e., the inlet rod 13 is capable of being inserted into or pulled out of the through bore 12*c* through the one end 12*a* of the die 12, while the second pelletizing rod, i.e., the outlet rod 8 is capable of being inserted into or pulled out of the through bore 12*c* through the other end 12*b*. The inlet rod 13 has a smaller diameter than that of the outlet rod 8. Therefore, the size, or width of a gap 15 extending substantially in parallel with the inlet rod 13 between the rod 13 and the inside surface of the die 12 (the size of the gap 15 being a value obtained by the subtraction of the diameter of the inlet rod 13 from that of the through hole 12*c*) is larger than the size, or width of a gap 16 extending substantially in parallel with the outlet rod 8 between the rod 8 and the inside surface of the die 12 (the size of the gap 16 being a value obtained by subtraction of the diameter of the outlet rod 8 from that of the through bore 12*c*). The construction of the first embodiment other than the portions described above with reference to FIG. 6, is the same as that previously mentioned with reference to FIGS. 1 through 5.

In accordance with the first embodiment, when the powder is compressed into a pellet by moving the inlet rod 13 rightwardly as viewed in FIG. 6, compressed air, as indicated by arrows A, is easily discharged through the gap 15 into the receiving cavity 23, i.e., into the interior of the pelletizer (that is, air is easily expelled out of the through bore 12*c*). Therefore, the time required for the compression of the powder into a pellet can be shortened as compared with the prior art. Namely, in the prior art, the inlet rod has the same diameter as the outlet rod, so that the sizes of gaps corresponding to the gaps 15, 16 are the same minute value (approximately 50 μm). Thus, the prior art involves disadvantage in that it is difficult to properly discharge the air compressed in the through bore 12*c* through the minute gaps and hence pelletizing time becomes longer. However, the first embodiment solves such disadvantage by making the size of the gap 15 larger than that of the gap 16. In accordance with the construction of the first embodiment, the air compressed during the pelletizing operation smoothly flows into the pelletizer through the gap 15 with a slight resistance, but never flows into the atmosphere through the gap 16. This mechanism is capable of solving the problem of environmental pollution caused by the discharge of a waste powder mixed with the compressed air into the atmosphere.

Figure 7:
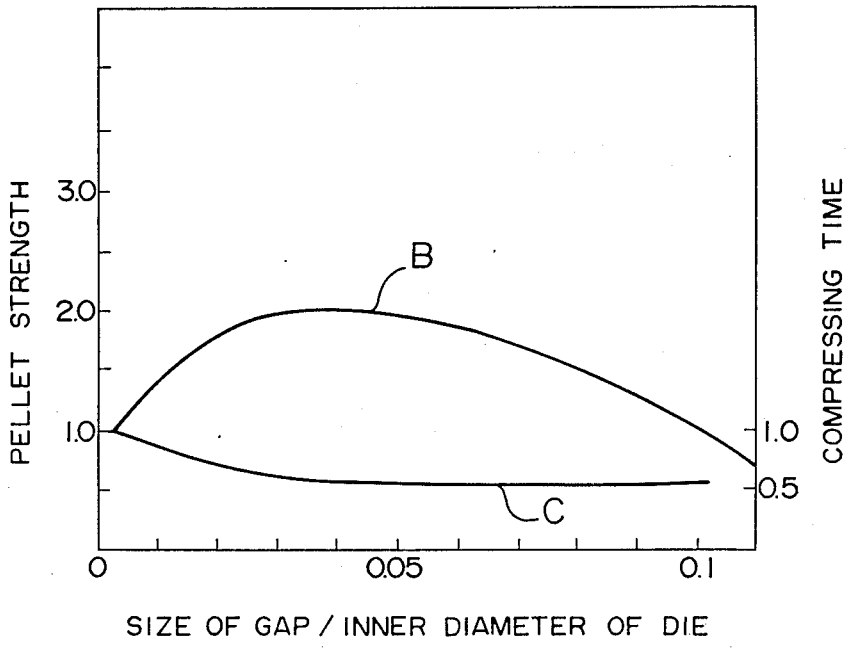
FIG. 7 schematically shows a pellet strength obtained and a compressing time required with the use of the apparatus of the first embodiment.

FIG. 7 is a graph showing the relationship among the size of the gap 15, a pellet strength, and a compressing time. In obtaining this graph, the size of the gap 15 between the inlet rod 13 and the die 12 was varied while the size of the gap 16 between the outlet rod 8 and the die 12 was set to a predetermined minimum value (approximately, 50 μm) for permitting the rod 8 to travel rightwardly and leftwardly. The FIG. 7 graph was obtained from experiments conducted by the inventors. The abscissa of the graph represents the ratio of the size of the gap 15 (that is the value obtained from the substraction of the diameter of the inlet rod 13 from the inner diameter of the die 12) to the inner diameter of the die 12 or the diameter of the through bore 12*c*, while the ordinates represent the pellet strength and the pelletizing or compressing time. The pellet strength is shown as the ratio of the strength of the pellet formed with the use of the pelletizer of the first embodiment to the strength of the pellet formed with the use of the prior art pelletizer, while the compressing time is shown as a ratio of the compressing time required with the use of the pelletizer of the first embodiment to the compressing time required with the use of the prior art pelletizer. The ratio values of both the pellet strength and the compressing time are shown as the values obtained under condition that each of the pellet strength and the compressing time according to the prior art is "1". In the prior art used, the ratio of the size of the gap 15 to the inner diameter of the dies 12 (or the diameter of the through bore 12*c*) was 0.002. The curve B represents the pellet strength, and the curve C represents the compressing time.

As can be seen from FIG. 7, as the size of the gap 15 is increased, air is easily discharged, so that the strength of the pellet is improved. However, when the ratio of the size of the gap 15 to the inner diameter of the die 12 becomes too large, variations occur in density of the pellet and hence the strength tends to be lowered. When the ratio of the size of the gap 15 to the inner diameter of the die 12 is near 0.03, the pellet strength takes the maximum value, and the compressing time is shortened approximately ½ as compared with the prior art. These results show that it is preferable that the ratio of the size or width of the gap 15 to the inner diameter of the die 12 is set within the numerical range between 0.005 and 0.1, and more preferably, within or near the numerical range between 0.03 and 0.04.

Figure 8:
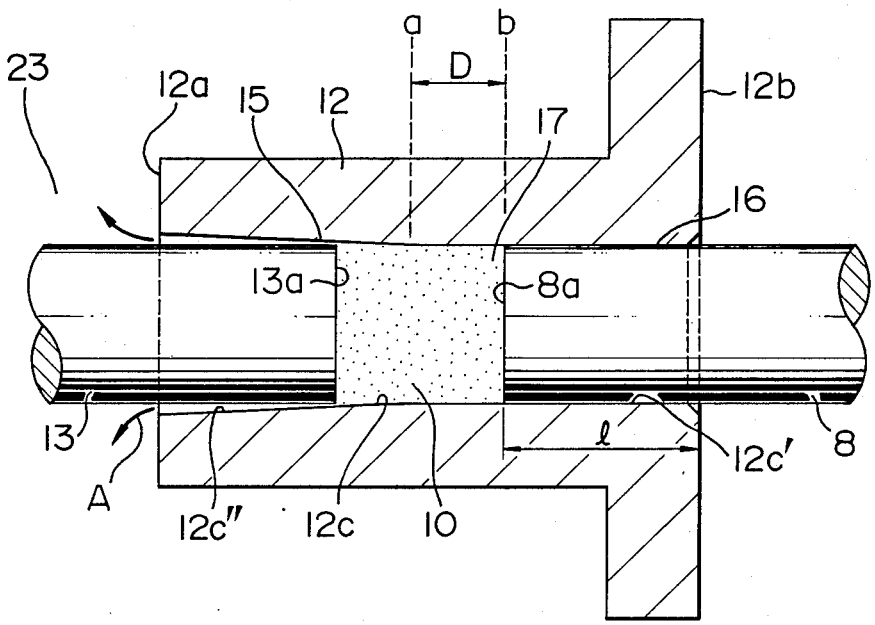
FIG. 8 is a sectional view showing the essential portion of a second embodiment of the pelletizing apparatus according to the invention.

FIG. 8 shows the second embodiment of the present invention. This embodiment is constructed such that the diameter of the second pelletizing rod or outlet rod 8 is made substantially identical with that of the first pelletizing rod or inlet rod 13 and the through bore 12*c* of the pelletizing die 12 has a taperbore portion 12*c*''. The air compressed in the through bore 12*c* during the pelletizing operation, as shown in arrows A, is discharged through the gap 15 defined between the inlet rod 13 and the die 12 into the powder receiving cavity 23, and the air is never leaked through the gap 16 defined between the outlet rod 8 and the die 12 into the atmosphere. More specifically, in the second embodiment, when a position a reached by an inner end 13*a* of the inlet rod 13 at the final stage of the pelletizing operation is defined as a boundary portion, the through bore 12*c* has a parallel-bore portion 12*c*'', which extends straight from the position a to the outer end 12*b* of the die 12 and the taper-bore portion 12*c*'' which extends from the position a to the inner end 12*a* of the die 12 in such a manner that the diameter is gradually increased toward the inner end 12*a*. Upon pelletizing operation, the inlet rod 13 travels rightwardly as viewed in FIG. 8, and when the inner end 13*a* of the rod 13 reaches the position a, the pelletizing operation is completed. In the embodiment illustrated in FIG. 8, the position a constitutes a boundary portion or point and the taper-bore portion 12*c*'' extends from the position a to the inner end 12*a* of the die 12. The boundary portion need not be located at the position a and, for example, it may be located at a position near the outer end 12*b* of the die 12. However, it is preferable that the boundary portion is located between a position b which an inner end 8*a* of the second pelletizing rod or outlet rod 8 takes during the pelletizing operation and the position a to which the inner end 13*a* of the first pelletizing rod or inlet rod 13 reaches at a final stage of the pelletizing operation. In other words, it is preferable that the boundary portion is located at a position within the area D in FIG. 8, since when it is located in this area the powder may be preferably compressed or press-molded between the inlet and the outlet rods 13 and 8. From this standpoint, it is particularly preferable that the boundary portion is located at the position a. The structures of the second embodiment other than the abovementioned structure are substantially similar to those of the first embodiment. Also in the second embodiment, compressed air is smoothly discharged through the gap 15 into the cavity 23 during the pelletizing operation, and hence the advantages substantially similar to those of the first embodiment are obtainable.

Figure 9:
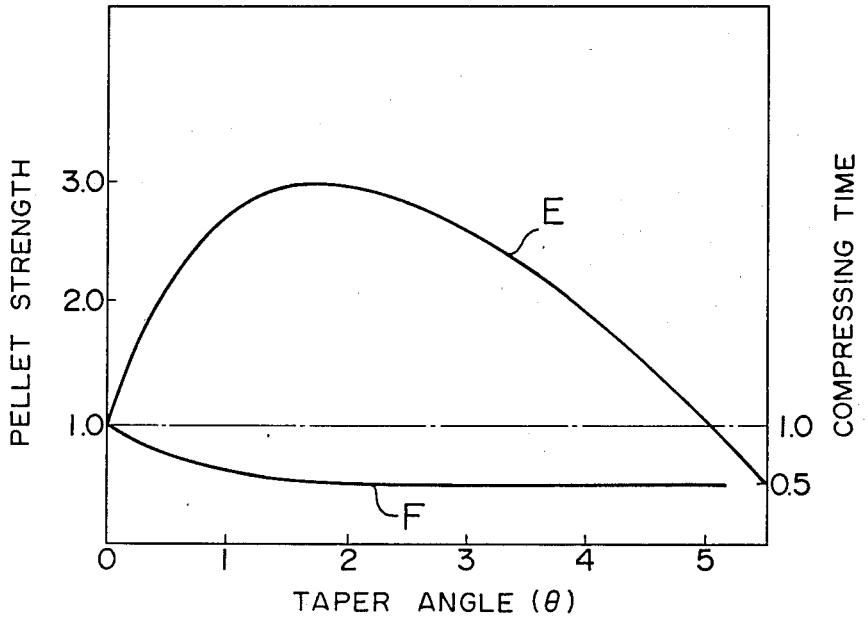
FIG. 9 schematically shows a pellet strength obtained and a compressing time required with the use of the apparatus of the second embodiment.

FIG. 9 is a graph showing the relationship among the taper angle (θ) of the taper-bore portion 12*c*'' of the second embodiment, pellet strength and compressing time. The FIG. 9 graph was obtained from experiments conducted by the inventors. The abscissa of the graph represents the taper angle (θ), while the ordinates represent the pellet strength and the pelletizing or compressing time. The pellet strength is shown as the ratio of the strength of the pellet formed with the use of the pelletizer of the second embodiment to the strength of the pellet formed with the use of the prior art pelletizer, while the compressing time is shown as the ratio of the compressing time required with the use of the pelletizer of the second embodiment to the compressing time required with the use of the prior art pelletizer. The ratio values of both the pellet strength and the compressing time are shown as the values obtained under condition that each of the pellet strength and the compressing time according to the prior art is "1". In FIG. 9, a curve E represents the pellet strength and a curve F represents the compressing time. In the experiments, the position of the inner end 8*a* of the outlet rod 8 during the pelletizing operation (i.e., the position b in FIG. 8) was the boundary portion. Thus, the part of the through bore 12*c* extending from the position b to the outer end 12*b* of the die 12 was made to be the parallel-bore portion 12*c*;, and the length of the portion 12*c'* was approximately 30mm. Further, the part of the through bore 12*c''* extending from the position b to the inner end 12*a* was made to be the taper-bore portion 12*c''*. The size or width of the gap 16 was approximately 50 μm. In the prior art used in the experiments, the taper angle (θ) was zero, and each of the gaps corresponding to the gaps 15 and 16 was approximately 50 μm.

The result of the experiments illustrated in FIG. 9 shows that, as the taper angle is increased, air in the through bore 12*c* is smoothly discharged through the gap 15 into the receiving cavity 23 and hence the pellet strength is increased, and at the same time the FIG. 9 graph shows the tendency that the uniformity of the pellet density or compactness and hence the pellet strength are lowered at the largely increased taper angle (θ). As can be seen, preferable pellet strength and compressing time were obtained at the taper angle (θ) within the range of 0.01 to 5 degrees. FIG. 9 shows that it is most preferable that the taper angle is within or near the range of 1 to 2 degrees. In the latter taper angle, the pellet strength becomes maximum and the compressing time is shortened to about ½ of that of the prior art.

EXAMPLE 1

In the first embodiment shown in FIG. 6, the inner diameter of the die 12 was ϕ28, the diameter of the outlet rod 8 was ϕ27.95, and the diameter of the inlet rod 13 was ϕ27.00 ((the gap 15 between the inner diameter of the die and the diameter of inlet rod) / (the inner diameter of the die)=0.036).

As a simulated substance of a radioactive waste powder, a powder of boric acid soda ($N_{a2}B_4O_7$) was employed and pelletized. As a result, compressed air produced in the course of compressing the powder was smoothly expeled through the gap 15 into the receiving cavity 23. The pellet strength was increased up to approximately twelve times that of the prior art, and the compressing time was reduced to about ½.

In addition, during the pelletizing operation, the powder was not scattered through the gap 16 into the atmosphere.

EXAMPLE 2

In the second embodiment shown in FIG. 8, the dimension 1 between the position b and the outer end 12*b* of the die 12 was approximately 30 mm, the part corresponding to the dimension 1 was formed into the parallel-bore portion 12*c'* and the part between the position b and the inner end 12*a* of the die 12 was formed into the taper-bore portion 12*c''*.

Although the taper angle θ of the taper bore portion 12*c''* is effective at θ>0, the density of the periphery of a pellet obtained, particularly the peripheral edge of the pellet adjacent to the periphery of the inner end 13*a* of the inlet rod 13, may become non-uniform if "θ" is too large. Therefore, in this example 2, "θ"=2°.

A simulated substance of a radioactive waste powder was pelletized between the rods 8 and 13 by using such pelletizer. As a result, compressed air produced in the course of compressing the powder was smoothly expelled through the gap 15 into the receiving cavity 23. As compared with the prior art pelletizer which is not formed with the taper-bore portion 12*c''*, compressing time was reduced to approximately ½. In addition, the powder was not scattered through the gap 16 to the atmosphere, and the strength of the obtained pellet was approximately three times that of the pellet formed by the prior art.

In this example, the part corresponding to the dimension 1 from the outer end 12*b* of the die 12 to the position b was formed into the parallel-bore portion 12*c'* and the part from the position b to the inner end 12*a* of the die was formed into the taper-bore portion 12*c''*. With such construction, it was possible to prevent such troubles as the decrease in strength of the formed pellet and the occurrence of cracks therein, and to form a pellet having the strength and appearance similar to or better than those of the pellet formed in the example 1. In order to prevent the troubles of the abovementioned kind, it is preferable that the through bore 12*c* has the parallel-bore portion 12*c'* of substantial length. Namely, although of course it is possible to adopt such construction that the parallel-bore portion 12*c'* has a very small length and the taper-bore portion 12*c''* extends from the vicinity of the outer end 12*b* of the die 12 to the inner end 12*a* of the die 12 in a manner to gradually increase the diameter toward the inner end 12*a*, it is more preferable that the parallel-bore portion 12*c'* extends from the outer end 12*b* of the die 12 to at least the position b so as to properly compress and press-mold the powder between the inlet and outlet rods 13 and 8.

It is to be noted that, although the experiments of examples 1 and 2 were conducted with the use of boric acid soda simulating a PWR (pressure water reactor) concentrated waste liquid, substantially same effects are obtainable when the invention is applied to the treatment of the BRW (boiling water reactor) concentrated waste liquid and a waste powder such as ashes of burnt waste resins.

Figure 10:
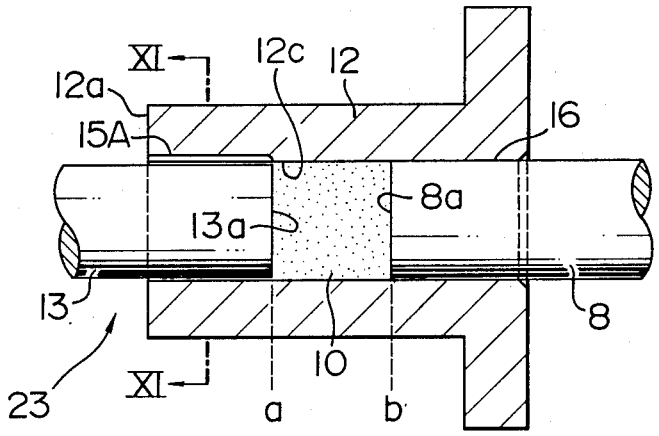
FIG. 10 is a sectional view showing the essential portion of a third embodiment of the pelletizing apparatus according to the invention.
Figure 11:
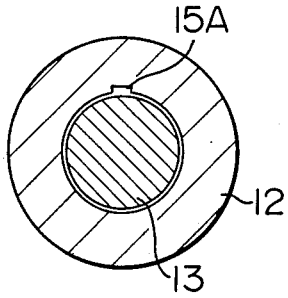
FIG. 11 is a sectional view taken along the line XI—XI of FIG. 10.

FIGS. 10, 11 show the third embodiment of the invention. In the third embodiment, the inlet rod 13 and the outlet rod 8 have substantially same diameter, and the diameter of the through bore 12*c* of the die 12 is substantially identical along substantially the entire length of the bore 12*c*. A groove 15A is so formed as to extend in the longitudinal or lengthwise direction of the inside surface of the die 12. In the illustrated embodiment, the groove 15A extends to the inner end 12*a* of the die 12 from the position a reached by the inner end 13*a* of the inlet rod 13 at the final stage of the pelletizing operation. It is possible to constitute such that the groove 15A extends to the inner end 12*a* from a position slightly rightwards from the position b of the inner end 8*a* of the outlet rod 8 during the pelletizing operation. However, in order to preferably compress and press-mold the powder between the rods 13, 8 it is preferable that the groove 15A extends to the inner end 12*a* from a given point located between the position a and the position b, and most preferably the groove 15A extends to the inner end 12*a* from the position a as in the illustrated embodiment. The structures of the third embodiment other than the structure described above are substantially similar to those of the first and second embodiments. The third embodiment brings about substantially similar effects to those of the first and second embodiments because of the fact that the air compressed during the pelletizing operation is smoothly guided and expelled through the groove 15A into the cavity 23.

Figure 12:
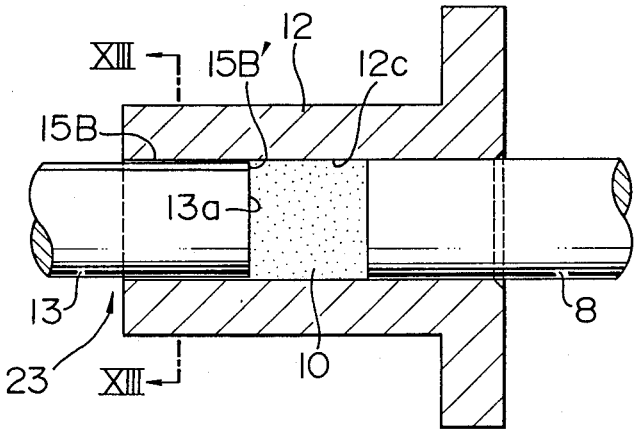
FIG. 12 is a sectional view showing the essential portion of a fourth embodiment of the pelletizing apparatus according to the present invention.
Figure 13:
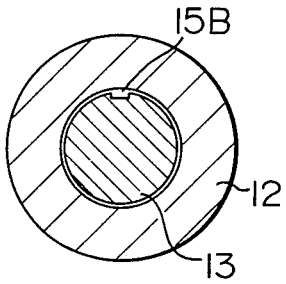
FIG. 13 is a sectional view taken along the line XIII—XIII of FIG. 12.

FIGS. 12, 13 show the fourth embodiment of the invention in which the inlet rod 13 and the outlet rod 8 have substantially the same diameter, and the inner diameter of the die 12, i.e., the diameter of the through bore 12*c* is substantially the same along substantially the entire length of the bore 12*c*. A groove 15B is so formed as to extend a predetermined length from the inner end 15*b*′ at the inner end 13*a* of the inlet rod 13 toward the outer end thereof along an outer periphery of the rod 13. The structures of the fourth embodiment other than those described above are substantially similar to those of the first to third embodiments. The fourth embodiment may bring about similar effects to those of the first to third embodiments since the air compressed during the pelletizing operation is smoothly expelled and discharged through the groove 15B into the receiving cavity 23.

As will be apparent from the foregoing description, the present invention brings about such meritorious effect that the time required for pelletizing a radioactive waste powder may be shortened and hence it is possible to enhance efficiency of the volume-reducing treatment of the powder. Also the invention contributes to the prevention of environmental polution since during the pelletizing operation the compressed air is discharged to the interior of the pelletizing apparatus rather than to the atmosphere and hence the powder is prevented from being scattered into the atmosphere.

What is claimed is:

1. An apparatus for pelletizing a radioactive waste powder comprising:

a pelletizing section having a radioactive powder receiving cavity:

die means including a pelletizing die which has one end facing and opening into said cavity defined in said pelletizing section for receiving said radioactive waste powder in said die from said cavity and the other end exposed to the atmosphere, said pelletizing die being formed therein with a through bore extending from said one end to said other end of said die;

a first pelletizing rod arranged to be inserted through said receiving cavity into said through bore from said one end of said die such as to be capable of being drawn out therefrom;

a second pelletizing rod arranged to be inserted into said through bore from said other end of said die such as to be capable of being drawn out therefrom;

forming an air and powder sealing connection between said second pelletizing rod and said through bore when said second pelletizing rod is within said bore;

means for operating said first and second pelletizing rods for keeping said second pelletizing rod in a position partially inserted into said through bore by a predetermined amount, and for simultaneously inserting said first pelletizing rod through said receiving cavity into said through bore and for moving said rods relatively toward each other to a final compressed position thereby pelletizing said powder into a pellet within said through bore; and air discharge passageway means extending from said through bore substantially between said rods in said final compressed position to said receiving cavity for guiding all the air compressed in said through bore during pelletizing to be discharged along with entrained powder only into said receiving cavity without causing any of said compressed air to leak around said second pelletizing rod with entrained powder into the atmosphere during said pelletizing operation thereby increasing the pellet strength, decreasing pelletizing time and preventing atmosphere contamination with the powder.

2. An apparatus for pelletizing a radioactive waste powder according to claim 1, wherein said through bore in said die has substantially the same diameter for substantially whole of its length, said first pelletizing rod has a diameter smaller than that of said second pelletizing rod, and said air discharge means includes a gap defined between said through bore and said first pelletizing rod, said gap being larger than a gap defined between said through bore and said second pelletizing rod.

3. An apparatus for pelletizing a radioactive waste powder according to claim 1, wherein said first and second pelletizing rods have substantially the same diameter, said through bore has a parallel-bore portion extending from a boundary portion to said other end of said die and a taper-bore portion extending from said boundary portion to said one end of said die such that a diameter thereof becomes gradually larger toward said one end, said boundary portion being located between a position of an inner end of said second pelletizing rod during the pelletizing operation and a position to which an inner end of said first pelletizing rod reaches at a final stage of the pelletizing operation, and said air discharge means includes a gap defined between said taper-bore portion and said first pelletizing rod.

4. An apparatus for pelletizing a radioactive waste powder according to claim 1, wherein said first and second pelletizing rods have substantially the same diameter, said through bore in said die has substantially the same diameter along its substantially entire length, and said air discharge means includes a groove extending longitudinally along the inside surface of said die, said groove extending to said one end of said die from a given position between a position of an inner end of said second pelletizing rod during the pelletizing operation and a position to which an inner end of said first pelletizing rod reaches at a final stage of the pelletizing operation.

5. An apparatus for pelletizing a radioactive waste powder according to claim 1, wherein said first and second pelletizing rods have substantially the same diameter, said through bore in said die has substantially the same diameter along its substantially entire length, and said air discharge means includes a groove formed in said first pelletizing rod, said groove extending a predetermined length from an inner end of said first pelletizing rod toward the other end thereof along an outer periphery of said first pelletizing rod.

6. An apparatus for pelletizing a radioactive waste powder according to claim 2, wherein the ratio of the size of said gap between said first pelletizing rod and said through bore to the diameter of said through bore is between 0.005 and 0.1.

7. An apparatus for pelletizing a radioactive waste powder according to claim 6, wherein the ratio of the size of said gap between said first pelletizing rod and said through bore to the diameter of said through bore is between 0.03 and 0.04.

8. An apparatus for pelletizing a radioactive waste powder according to claim 3, wherein said boundary portion is located at the position at which an inner end of said first pelletizing rod reaches at a final stage of the pelletizing operation.

9. An apparatus for pelletizing a radioactive waste powder according to claim 4, wherein said groove extends to said one end of said die from the position at which an inner end of said first pelletizing rod reaches at a final stage of the pelletizing operation.

10. An apparatus for pelletizing a radioactive waste powder according to claim 3, wherein a taper angle of said taper-bore portion of said through bore is between 0.01 and 5 degrees.

11. A method for pelletizing a radioactive waste powder comprising:

providing a pelletizing section having a receiving cavity;

feeding radioactive waste powder into said cavity;

providing a pelletizing die with one end facing said cavity defined in said pelletizing section, and receiving said radioactive waste powder in said die through said one end from said cavity and exposing the other end to the atmosphere;

forming a through bore extending from said one end to said other end of said die;

inserting a first pelletizing rod through said receiving cavity into said through bore from said one end of said die such as to be capable of being drawn out therefrom;

inserting a second pelletizing rod into said through bore from said other end of said die such as to be capable of being drawn out therefrom;

forming an air and powder sealing connection between said second pelletizing rod and said through bore when said second pelletizing rod is within said bore;

operating said first and second pelletizing rods for keeping said second pelletizing rod in a position partially inserted into said through bore by a predetermined amount, and for simultaneously inserting said first pelletizing rod through said receiving cavity into said through bore and moving said rods relatively toward each other to a final compressed position, thereby pelletizing said powder into a pellet within said through bore;

forming a passageway extending from said through bore substantially between said rods in said final compressed position to said receiving cavity; and guiding all of the air compressed in said through bore along the passageway during pelletizing to be discharged along with entrained powder only into said receiving cavity and preventing any of said compressed air to leak around said second pelletizing rod with entrained powder into the atmosphere during said pelletizing operation thereby increasing the pellet strength, decreasing pelletizing time and preventing atmosphere contamination with the powder.

12. A method according to claim 11, further including the steps of:

after said step of pelletizing and said step of guiding withdrawing said second pelletizing rod from said die to be spaced therefrom and open the other end of said die to the atmosphere; and moving said first pelletizing rod through said other end of said die to discharge the pelletized powder from said die.

13. A method according to claim 12, thereafter including the steps of:

withdrawing said first pelletizing rod from said die and inserting said second pelletizing rod into said die to prevent the escape of gases from said cavity; and further withdrawing said first pelletizing rod a sufficient distance from said one end of said cavity to permit radioactive powder within said cavity to enter said one end and partially withdrawing said second rod to said partially inserted stationary position to permit radioactive powder to enter said bore; and thereafter repeating all of the above steps in order.

* * * * *